United States Patent [19]

Fujii et al.

[11] Patent Number: 4,674,654

[45] Date of Patent: Jun. 23, 1987

[54] LIQUID DISPENSER HAVING SOUND GENERATING MECHANISM

[76] Inventors: Mituru Fujii, 704-11, Shikatebukuro, Urawa-shi, Saitama-ken; Tomoyuki Dobashi, 2-1-3, Tsujido Motomachi, Fujisawa-shi, Kanagawa-ken; Hisashi Sasaki, 13-1, Totsukahasamimachi, Kawaguchi-shi, Saitama-ken; Masamichi Imanishi, 7-254, Otodamachi, Ikoma-shi, Nara-ken; Toshihiro Ueda, Santareiru Ibaraki B114 4-14-114 Shimehozumi, Ibaraki-shi, Osaka, all of Japan

[21] Appl. No.: 753,814

[22] Filed: Jul. 9, 1985

Related U.S. Application Data

[63] Continuation-in-part of Ser. No. 549,592, Nov. 7, 1983, abandoned.

[30] Foreign Application Priority Data

Nov. 24, 1982 [JP] Japan ..... 57-204540
Apr. 28, 1983 [JP] Japan ..... 58-62888[U]

[51] Int. Cl.[4] ..... B65D 25/48

[52] U.S. Cl. ..... 222/39; 222/478; 222/567

[58] Field of Search ..... 222/39, 478, 567; 116/264

[56] References Cited

U.S. PATENT DOCUMENTS

| | | | |
|---|---|---|---|
| 396,376 | 1/1889 | Spear | 222/39 |
| 417,639 | 12/1889 | Hess | 222/39 |
| 2,152,459 | 3/1939 | Biasco | 222/39 |
| 2,257,656 | 9/1941 | Scully et al. | 222/39 |

FOREIGN PATENT DOCUMENTS

| | | | |
|---|---|---|---|
| 3005 | 2/1978 | Fed. Rep. of Germany . | |
| 821769 | 10/1959 | United Kingdom . | |
| 2063205 | 6/1981 | United Kingdom | 222/478 |

*Primary Examiner*—Joseph J. Rolla
*Assistant Examiner*—Frederick R. Handren
*Attorney, Agent, or Firm*—Wolf, Greenfield & Sacks

[57] ABSTRACT

A liquid dispenser having an air introduction tube with a sound generating mechanism for mounting to an opening of a container holding a liquid such as beer. When liquid is poured through the dispenser a pulsating air flow is generated in the air introduction tube which causes the sound generating mechanism to produce a chirping sound.

5 Claims, 15 Drawing Figures

Fig. 9
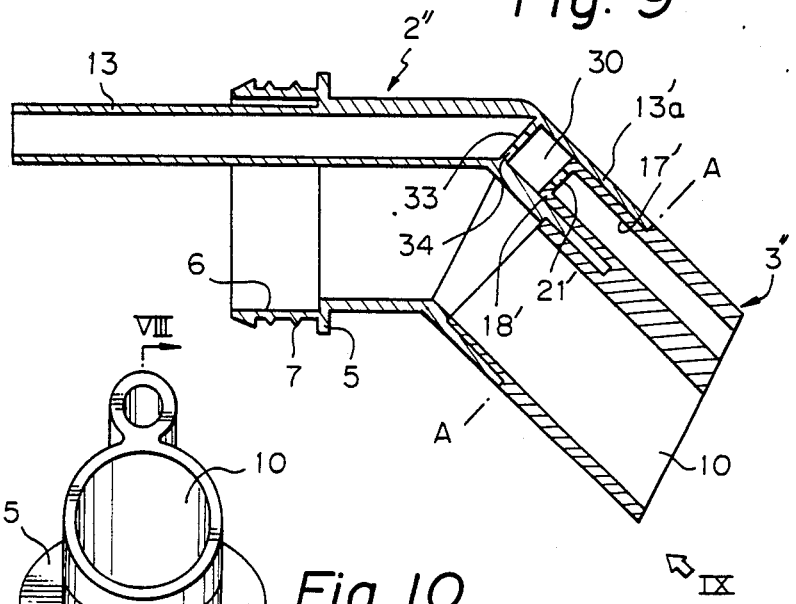
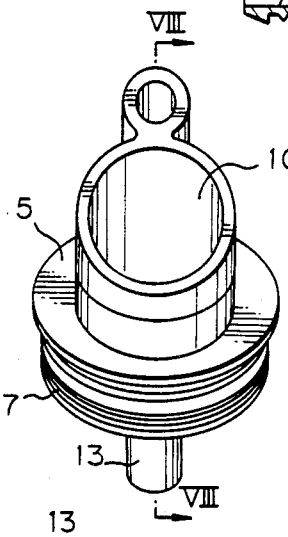
Fig. 10
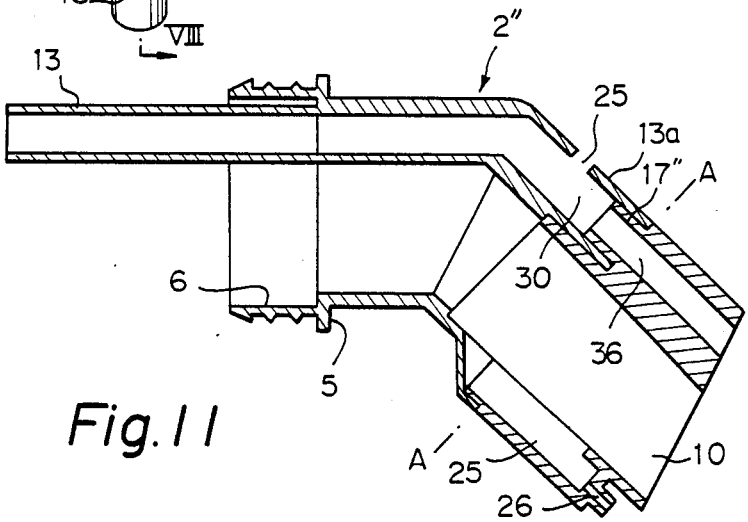
Fig. 11

LIQUID DISPENSER HAVING SOUND GENERATING MECHANISM

This application is a continuation-in-part of application Ser. No. 549,592, filed Nov. 7, 1983, now abandoned.

BACKGROUND OF THE INVENTION

1. Field of the Invention

The present invention relates to a liquid dispenser, and more particularly to a dispenser adapted to attach to an opening of a container, e.g. a can, a barrel, or a bottle, to dispense easily the liquid in the container.

2. Description of the Prior Art

Recently, beer packed in a medium capacity metal or plastic container, e.g. 2 liter and 3 liter container, has begun to be sold. It is desired that a dispenser may be attached to such a container after the closure has been removed in order to dispense the beer easily to a mug or a glass. Many kinds of such dispensers have been proposed. However, the objective of such dispensers has been to solve problems and disadvantages associated with the dispenser itself, such as easy attachment to the container or easy control of pouring quantity. However, such improvements relate only to essential pouring functions.

One pouring problem which often occurs when liquid is poured quickly from a large bottle into a glass is that because of an intermittent liquid flow the liquid overflows the glass. An intermittent liquid flow, which occurs when an unsealed bottle filled with liquid is sharply tilted, is generated in the following stages.

As a first stage, a part of the liquid inside the mouth of the bottle is pushed down and flows out due to the hydrostatic pressure of the liquid because the air pressure inside the bottle is equal to the atmospheric pressure. The flowing out of the liquid increases the volume of the air occupying the space above the liquid in the bottle and lowers its pressure.

As a second stage, when the total pressure on the lower surface of the liquid which is a combination of hydrostatic pressure and the air pressure in the bottle, becomes less than the atmospheric pressure, the liquid flow stops and the air under the lower surface of the liquid enters and rises up as a bubble due to its buoyancy through the liquid to the upper surface. When, by the entering of the air into the bottle, the total pressure on the lower surface of the liquid becomes greater than the atmospheric pressure, a part of the liquid newly occupying the inside of the mouth flows out as in the first stage. Thus, the alternate occurence of the liquid flow stage and the air entry stage generates the intermittent flow.

Many inventions and improvements propose to use an air introduction tube, guiding air from the outside of the container into the air space above the liquid in the container. The air introduction tube makes the liquid flow smoothly because the air is introduced continuously through the tube.

SUMMARY OF THE INVENTION

The present invention aims to provide a liquid dispenser which is adapted to attach to a beverage container and which has effective pouring properties as well as the new property of producing an agreeable sound when the beverage is poured from the container.

According to the present invention, the liquid dispenser comprises at least one liquid pouring conduit, an air introduction tube, and a sound generating means in the air introduction tube.

By selecting the diameter and length of the air introduction tube, intermittent or pulsating air flow is produced in the tube when liquid such as beer is poured from the container through the liquid pouring conduit to a mug or a glass. Thus, when a sound producing mechanism is combined with the air introduction tube, the produced sound is not a long-lasting whistle sound, but rather a "cheep" sound or the intermittent sound of a chick. Consequently, the produced sound is agreeable to hear for users of a wide range The sound producing mechanism may be selected from any known means of such sound production. The mechanism may be a reed, or a small hole or holes throttling the air flow in the air introduction chamber, or it may be a side hole opened to the air introduction tube. In the case of a small hole or holes, a resonance chamber may be constructed in the air introduction tube.

BRIEF DESCRIPTION OF THE DRAWINGS

The foregoing as well as additional features and advantages of the invention will become more apparent as the following detailed description of preferred embodiments is read. The description, explained, by way of example, should be read in conjunction with the accompanying drawing, wherein like reference numerals denote like parts in all views and wherein:

FIG. 9 is a longitudinal sectional view of a dispenser, according to the third embodiment of the present invention;

FIG. 10 is an end view of the dispenser, viewed along arrow IX of FIG. 9;

FIG. 11 is a longitudinal section view of a dispenser, according to the fourth embodiment of the present invention;

BRIEF DESCRIPTION OF THE PREFERRED EMBODIMENTS

Figure 1:
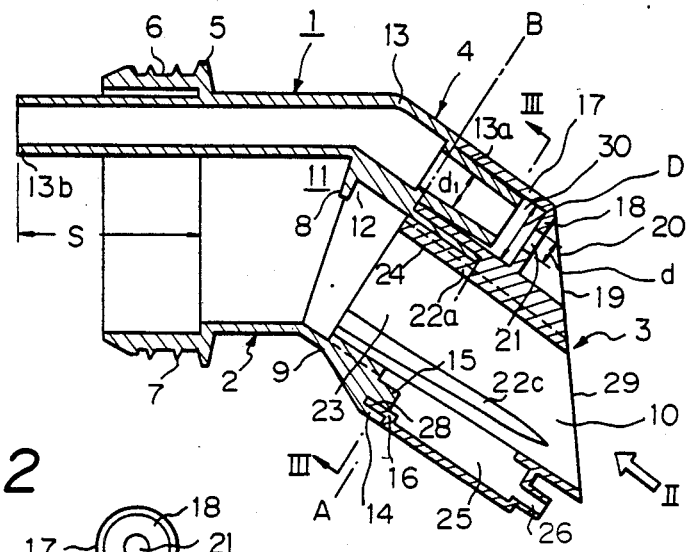
FIG. 1 is a longitudinal sectional view of a dispenser, according to the first embodiment of the present invention.
Figure 2:
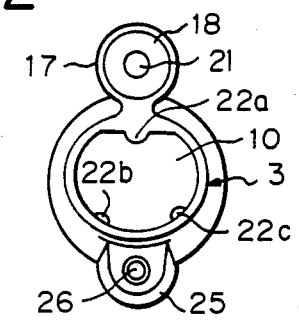
FIG. 2 is an end view along arrow II of FIG. 1.
Figure 4:
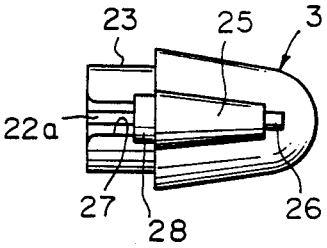
FIG. 4 is a bottom view of the pouring nozzle of the dispenser shown in FIG. 1.
Figure 3:
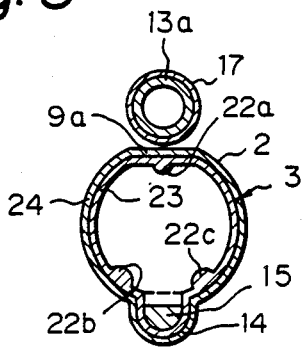
FIG. 3 is a sectional view along line III—III of FIG. 1.

The liquid dispenser of the present invention comprises at least one liquid pouring conduit, an air introduction tube, and a sound generating means in the air introduction tube. The dispenser is detachably mounted to an opening of a liquid container By selecting the diameter and the length of the air introduction tube, when liquid is poured from the container through the liquid pouring conduit a pulsating air flow is generated in the air introduction tube which causes the sound producing mechanism to generate an intermittent chirping sound. Furthermore, the dispenser causes a liquid flow having a finer vibration which generates a finer foam of carbon dioxide in beer poured through the dispenser into a receptacle.

The principal conditions to give a pouring flow a finer vibration are described in Japanese specifications of Laying-open No. 82-28797 (App. No. 80-94380) and Laying-open No. 83-82853 (App. No. 81-173296). The inside diameter of the air introduction tube is from 1 to 6 mm, preferably from 2 to 4 mm. The projecting length of the air introduction tube into the container is up to 50 mm, preferably from 30 to 40 mm. Generally, the pulse of liquid flow becomes longer as the inside area of the tube becomes larger and the pulse becomes stronger as the length of the air introduction tube becomes shorter. Conversely, the pulse becomes finer as the inside area of the tube becomes smaller and the pulse is weakened by the elongation of the tube and disappears when the tube reaches the surface of the liquid.

The pulse of the liquid flow is due to the formation and departure of an air bubble from an end of the air introduction tube. When the air bubble departs from the end of the tube, the liquid, pushed aside by the bubble, rushes into the outlet of the tube and causes a shock spreading through the liquid. Thus, a narrower tube makes a smaller bubble and causes a smaller pulse, and a wider tube makes a larger bubble and causes a larger pulse. As the projecting length of the tube becomes longer, the shock waves caused by the departure of the air bubble from the end of the tube is weakened as it travels a long distance through the liquid to the outlet.

We have determined the conditions under which an air bubble generates a pulsating air flow in the air introduction tube. To produce the pulsating air flow the inner end of the air introduction tube must be positioned beneath the surface of the liquid in the bottle when the liquid is poured, and there are critical limitations on the length and diameter of the air introduction tube. If the inside diameter of the air introduction tube is smaller than 2 mm, the air flow does not have enough power to produce a sound. If the inside diameter is larger than 6 mm, there is a risk, that liquid might flow into the air introduction tube and impede the sound generating mechanism, especially if the projecting length of the tube is shorter. If the projecting length is longer than 100 mm, the end of the tube projects above the surface of the liquid during pouring even when a considerable quantity of liquid remains in the bottle and the sound ceases. Therefore, to produce a pulsating air flow the inside diameter of the air introduction tube should preferably be from 2 to 6 mm, and the tube should extend from 10 to 60 mm inside the container.

Referring now to FIGS. 1–4, a dispenser 1 according to first preferred embodiment of the present invention, is formed by a body 2 and a pouring nozzle 3. The body 2 bends at a certain angle at the outlet which is the right end portion shown in FIG. 1. At the left end shown in FIG. 1, the body 2 forms an integrally secured flange 5. Contiguous with the flange 5, an attached cylindrical body 6 is formed integral with the body 2. On the periphery of the cylindrical body 6, several projections 7 are formed. By means of the projections 7, the dispenser 1 can be pressed into an opening of a liquid container, not shown, in a sealed and removable relationship.

In the bent portion of the body 2, a semi-circular partition wall 8 is projected from the top portion of the inside periphery of the body 2 into a passage 10 of a pouring barrel 9. By the partition wall 8, air stagnation spaces 11 and 12 are formed adjacent to the bent portion of the main pouring passage 10 when liquid is poured through the passage 10. When the container is raised up to stop pouring the air remaining in the air stagnation space 11 makes the remaining beer foam in the passage 10 separate from the upper wall of the passage 10, so the beer foam easily slides down into the container. This prevents a beer foam burst caused by the pressure of gasified carbon dioxide in the container. The free end of the body 2 is adapted to engage smoothly with the pouring nozzle, as will be explained in detail later. Upwards, and spaced from the top portion 9*a*, outer end 13*a* of an air introduction tube 13 with "cheep" mechanism i.e. sound producing mechanism to be described later, is positioned. A projection 14 is integrally formed with the body 2, opposite to the tube 13. Inside the projection 14, a backing element 15 is formed and an insertable recess 16 of generally semicircular cross section is formed between the backing element 15 and the projection 14.

The inner end 13*b*, or left end in FIG. 1, of the air introduction tube 13 is projected beyond the attachment flange 5 for a predetermined distance s. Preferably the distance s is from 10 to 60 mm. On the outer end 13*a*, or right end in FIG. 1, of the air introduction tube 13, a "cheep" tube 17 is mounted. The "cheep" tube 17 is open at one end and is closed at the other side by a partition wall 18 which has a small hole 21. Projected further from the partition wall 18, the tube 17 forms a cover tube 19 which forms a taper surface 20 at its open end. Preferably the inner diameter of the air introduction tube is from 2 to 6 mm. In the illustrated embodiment, inner diameter $d_1$ of the outer end 13*a* of the air introduction tube is about 4–6 mm, while the inner diameter d of the small hole 21 of the "cheep" tube 17 is about 2.7–3.3 mm, and the inner diameter D of a chamber 30 formed in the tube 17 adjacent to the hole 21 is about 7–10 mm.

The pouring nozzle 3 forms a plurality of axially extending semi-circular sectioned projections 22*a*, 22*b*, and 22*c*. The projections add rigidity to the nozzle 3 and prevent the nozzle 3 from deformation when the nozzle 3 is mounted on the barrel 9. The pouring nozzle 3 forms a thin-walled fitting portion 23 which fits in a thin-walled opening 24 formed at the open end of the pouring barrel 9. A subsidiary flow chamber 25 is formed integrally under pouring passage 10 with the nozzle 3. At the right end in FIG. 1, the subsidiary flow chamber opens to a subsidiary pouring outlet 26. The upper surface of the subsidiary flow chamber 25 is open with the main pouring passage 10. At the left end of the subsidiary chamber 25, a cutout 27 is formed in the thin wall portion 23. A semi-circular sectioned insert wall 28 is formed adjacent the cutout 27. The insert wall 28 is inserted in the above-described insertable recess 16 of the body 2. The main pouring passage 10 of the pouring nozzle 3 forms a tapered outlet surface 29.

To use the dispenser 1, the cylindrical body 6 is pressed into the opening of the liquid container so that the dispenser 1 is fixed with the container. As usual, the container is held and tilted to pour the liquid, e.g. beer into the mug. When the liquid is poured, air is introduced into the tube 13 through the small hole 21 of the "cheep" tube 17 and the chamber 30. The small hole 21 functions as an orifice, which makes turbulence on the air flow passing therethrough, and the chamber 30 acts as a resonator to produce sound. As the air flow through the tube 13 is intermittent, the sound is not a long-lasting whistle sound, but is an intermittent sound of "cheep" such as that a little bird would make. The "cheep" sound is agreeable and delightful to hear.

When the liquid in the container is poured, aided by air introduced via tube 13, through the main pouring passage 10 of the pouring nozzle 3, the liquid in the subsidiary flow chamber 25 is poured simultaneously from the subsidiary outlet 26. Liquid poured through the subsidiary outlet 26 applies fine vibrations to the liquid level surface which is already formed by previously poured liquid. Thus, carbon dioxide dissolved in the liquid is separated by the vibration into numerous fine bubbles which cover the liquid surface. In this way the entraining of air is limited only to the initial stage of pouring and thus the generation of air foams is effectively decreased.

When the container is raised to stop the pouring, liquid and foam in the passages of the dispenser 1 return back into the container. While pouring, stagnant air in the stagnation spaces 11 and 12 on both sides of the wall 14 decreases viscosity resistance between the liquid flowing back into the container, and also prevents the inadvertent injection.

The sound of the "cheep" mechanism is determined by diameter d of the small hole 21, diameter D and the axial length of the chamber 30, and the material from which the "cheep" tube 17 is constructed. By projecting the inner end **13*b* of the air introduction tube 13** into the container for a predetermined length, a fine pulsatory motion is produced in the flowing air so that an intermittent "cheep" sound is produced instead of a whistle sound.

After all liquid in the container is consumed, the dispenser 1 may be removed from the container. The removed dispenser 1 can be utilized as a whistle. The inner end **13*b* of the air introduction tube 13 is held in the mouth and air is blown or sucked through the tube. By blowing or sucking air a resonance phenomenon is produced in the tube 17** so that whistling sound is produced.

Figure 5:
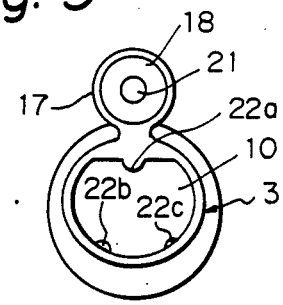
FIG. 5 is an end view similar to FIG. 2 showing a variation of the dispenser shown in FIG. 1.

FIG. 5 shows a variation of the dispenser shown in FIG. 1. Note that in FIG. 5 the subsidiary passage and the outlet thereof are eliminated from the dispenser 1; the other construction of the dispenser shown in FIG. 5 is similar to that of the dispenser shown in FIG. 1.

Figure 7:
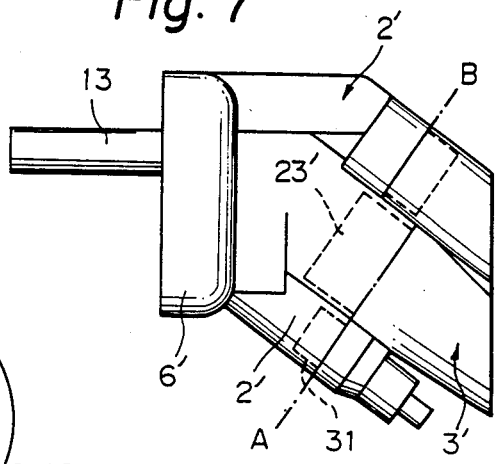
FIG. 7 is a side view of the dispenser shown in FIG. 6.
Figure 6:
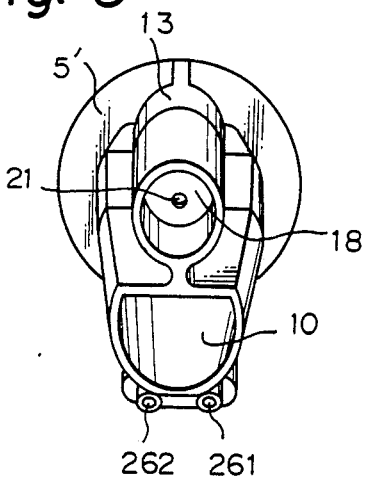
FIG. 6 is a front view of a dispenser, according to the second embodiment of the present invention.
Figure 8:
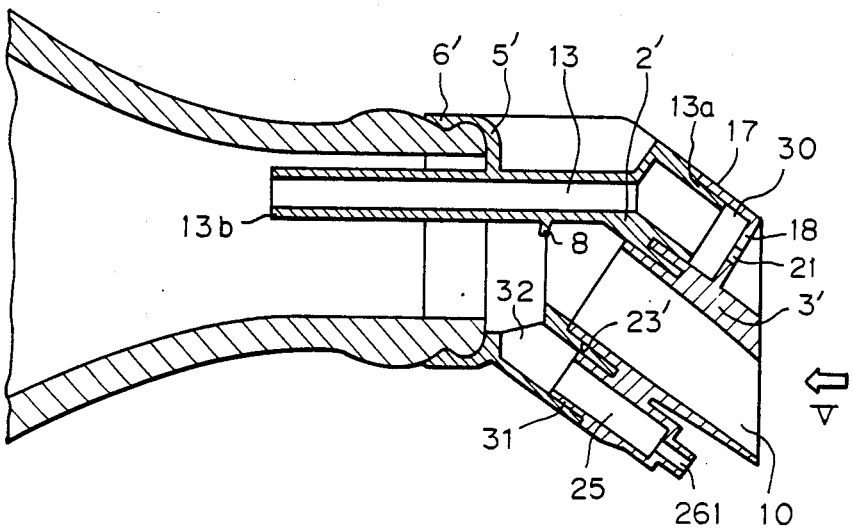
FIG. 8 is a longitudinal sectional view of the dispenser shown in FIG. 6 attached to the mouth of a bottle.

FIGS. 6–8 show a dispenser according to a second embodiment of the present invention. The dispenser shown in FIGS. 6–8 is formed from suitable plastic material, e.g. polyethylene or polypropylene, as is the dispenser 1 shown in FIGS. 1–4, and consists of a dispenser body 2' and a pouring nozzle 3' which are fit together. The air introduction tube 13 is formed integral with the body 2' while the outer end **13*a* is received in the "cheep" tube 17 which is integrally formed with the pouring nozzle 3'. As before, the "cheep" tube 17 has the partition wall 18 having the small hole 21**.

The pouring nozzle 3' includes a nozzle body portion having the "cheep" tube 17 and the main pouring outlet 10 includes a subsidiary outlet portion having two subsidiary outlets 261 and 262. As shown in FIG. 8, a fitting end portion 31 of the main passage 10 is generally semicircular with a flat top portion, and a fitting end portion 31 which communicates with the subsidiary outlets 261 and 262 and which is generally oval in the illustrated embodiment. The shape of the fitting portion may be selected as desired. The subsidiary flow chambers 25 do not directly communicate with the main flow passage 10, but communicate through an opening 32 adjacent to flange 5' of the main body 2'. The operation of the dispenser shown in FIGS. 6–8 is similar to that of the dispenser shown in FIGS. 1–4.

FIGS. 9 and 10 show a dispenser according to a third embodiment of the present invention. In the above described embodiments, the dispenser body 2 or 2' fits with the pouring nozzle 3 or 3' along an outer fit line A - B, while the main passage portion of pouring nozzle 3'' is fit in main body 2'', and the right end portion **13'*a* of the air introduction tube 13 is secured onto the "cheep" tube 17' which is integral with the pouring nozzle 3''. In the embodiment shown in FIGS. 9 and 10, the end surface of dispenser body 2'' is substantially flat and outer fit line A—A is linear. Each portion of the dispenser nozzle 3'' is mounted onto each portion of the body 2''. More particularly, "cheep" tube 17' is integral with the pouring nozzle 3'' and on the free end of the tube 17', an end wall 18' with a small hole 21' is integrally formed. Opposed to and spaced from the small hole 21', a small hole 33 is formed in a partition wall 34 which is molded into the air introduction tube 13. Between the walls 34 and 18', a chamber 30 having a predetermined axial length and a predetermined inside diameter is defined in the air introduction tube. When the air column defined by the chamber 30** is resonated, sound is produced.

In a preferred embodiment of the "cheep" mechanism, or the sound producing mechanism, the thickness of the walls 18' and 34 is 1.0 mm, the inside diameter of the small holes 21' and 33 is 2.8 mm, the length of the chamber i.e. distance between the partition walls 18' and 34, is 10 mm, and the inside diameter of the air introduction tube 13 and the "cheep' tube 17 is 4 mm.

The embodiment shown in FIGS. 9 and 10 has no subsidiary pouring outlet, and connection between the body 2'' and the pouring nozzle 3'' is rather weakly defined compared with the first and second embodiments. However, construction is very simple and compact.

FIG. 11 shows a dispenser, according to a fourth embodiment of the present invention. The only difference between this fourth embodiment and the third embodiment shown in FIGS. 9 and 10 is the sound producing mechanism. In the embodiment shown in FIG. 11, a small hole 25 is opened to the outer wall of the dispenser body 2'' to communicate with the air introduction tube 2''. The "cheep" tube 17'' without the former wall 18' is secured in the outer end **13*a* of the air introduction tube 13. A space defined between the inner end of the "cheep" tube 17'' and the small hole 25 acts as the above-mentioned chamber 30. Also, in the embodiment the subsidiary flow chamber 25 which communicates with the main pouring passage 10, and a subsidiary outlet 26** is provided as in the first embodiment.

FIGS. 12–15 show a dispenser 40, according to a fifth embodiment of the present invention. The dispenser 40 has a flange 5 with a cylindrical attachment body 6, a dispenser body 42 which forms both an inlet 41 and a pouring outlet 10, a projection 43 which forms a subsidiary flow chamber 25 in communication with both the main flow passage 10 and a subsidiary outlet 26, and finally an upper projection which defines an air introduction tube 13.

Figure 12:
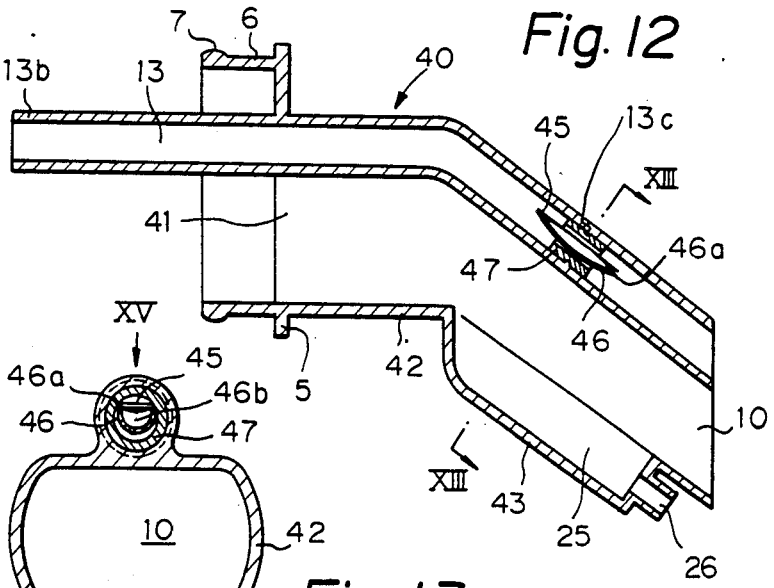
FIG. 12 is a longitudinal section view of a dispenser, according to the fifth embodiment of the present invention.
Figure 13:
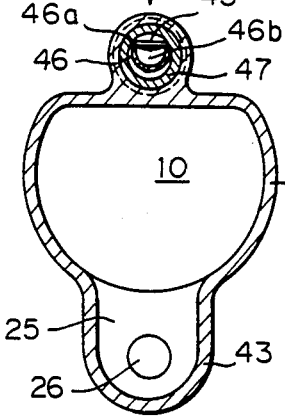
FIG. 13 is a cross section view along line XIII—XIII of FIG. 12.
Figure 14:
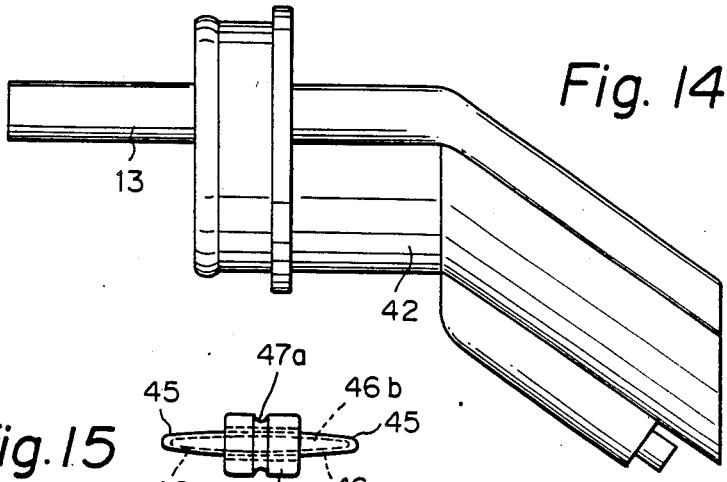
FIG. 14 is a side view of the dispenser shown in FIG. 12.
Figure 15:
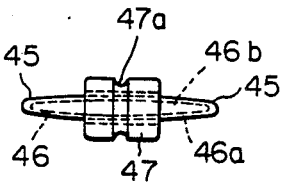
FIG. 15 is a plan view of a reed mechanism of the dispenser along line XV of FIG. 13.

As a sound producing mechanism, a reed mechanism is utilized in the dispenser 40. Any desired reed mechanism may be inserted into the air introduction tube 13. In the illustrated embodiment, the reed mechanism includes an elastic reed 45 formed by a thin metal plate, a rigid scaphoid or boat-shaped member 46 which has a peripheral portion generally corresponding to that of the reed 45 and a recess **46*b* spaced from the reed 45, and a short sleeve 47 holding the reed 45 and the boat-shaped member 46. The short sleeve 47 is adapted to insert into the air introduction tube 13. The sleeve 47 may be secured in the tube 13 by any desired means. In the embodiment shown, the sleeve 47 has peripheral groove 47*a* which engages with one or more projections 13*c* which have been formed inside the air introduction tube 13 so that the reed mechanism is secured with the tube 13 in a selected position. The sleeve 47 and the dispenser body 42 are preferably made of a suitable plastic material. The reed assembly consisting of the reed 45, boat-shaped member 46 and sleeve 47 can be pushed into the air introduction tube 13 from the right end as shown in FIG. 12. The boat shaped member 46 forms a throttle in the air introduction tube 13 and induces air flow to the reed 45 to effect vibration of the reed 45. Thus, the desired sound determined by the reed 45 is produced. In the illustrated embodiment, the reed 45 produces sound in both air flow directions, i.e. the dispenser 40 can be used as a whistle when air is blown from the left end 13*b* of the air introduction tube. For dispenser use, the reed 45** may be made as a one direction whistle.

The subsidiary pouring outlet shown in the embodiments of FIGS. 1, 7, 11 and 12 is effective to produce fine foam bubbles when beer is used with the dispenser. However, according to the present invention the subsidiary outlet may be eliminated from the dispenser as shown in the embodiments represented in FIGS. 5 and 10.

As described in detail, the dispenser of the present invention pours beverages, e.g. beer ideally and has a very simple sound producing mechanism i.e. a "cheep" mechanism combined with the air introduction tube. Thus, when the beverage is poured, an agreeable sound is produced by the intermittent air flow in the air introduction tube. As the user of the dispenser pours the beverage and hears the agreeable sound, the user may approve more of the beverage itself. Because the dispenser can after the container is empty, be utilized as a whistle, the dispenser itself is likely to gain approval by younger boys. Consequently, the dispenser, of the present invention produces a "cheep" sound when the beverage is poured and also produces a whistle sound after the dispenser is removed from the container so that two kinds of sound are produced.

We claim:

1. A liquid dispenser for detachably mounting to an opening of a liquid container and generating a chirping sound when liquid is poured from the container, said dispenser comprising:

a central body portion having means for detachably mounting the dispenser to an opening of a liquid container;

at least one liquid pouring conduit extending through the central body portion:;

an air introduction tube extending through the central body portion and having an inner tube portion extending proximal of the central body portion which is positionable within the container and an outer tube portion extending distal of the central body portion which is positionable outside the container, said outer tube portion having a predetermined diameter;

a sound generating mechanism located in the outer tube portion comprising a constricted opening having a diameter less than said predetermined diameter;

said inner tube portion having an open inner end which terminates close to said central body portion so that it remains beneath the surface of liquid in the container when liquid is poured through the pouring conduit so as to cause an intermittent air flow through the sound generating mechanism and generate a chirping sound when liquid is poured from the container.

2. The dispenser of claim 1 wherein said dispenser comprises a molded body.

3. The dispenser of claim 1, wherein said constricted opening is formed in the outer wall of the outer tube portion.

4. The dispenser of claim 1, wherein said sound generating mechanism includes a partition wall in the outer tube portion and said constricted opening is located in said partition wall.

5. The dispenser of claim 1, further comprising a reed disposed within said constricted opening.

* * * * *